United States Patent [19]

Gobush

[11] Patent Number: 4,762,326

[45] Date of Patent: Aug. 9, 1988

[54] GOLF BALL

[75] Inventor: William Gobush, No. Dartmouth, Mass.

[73] Assignee: Acushnet Company, New Bedford, Mass.

[21] Appl. No.: 58,031

[22] Filed: Jun. 4, 1987

[51] Int. Cl.[4] ..... A63B 37/14

[52] U.S. Cl. ..... 273/232; 273/183 C

[58] Field of Search ..... 273/232, 233, 213, 62, 273/183 C; 40/327

[56] References Cited

U.S. PATENT DOCUMENTS 4,560,168 12/1985 Aoyama ..... 273/232

FOREIGN PATENT DOCUMENTS 377354 7/1932 United Kingdom ..... 273/232

*Primary Examiner*—George J. Marlo

*Attorney, Agent, or Firm*—Lucas & Just

[57] ABSTRACT

A golf ball having dimples covering its surface and having seven great circular paths on the surface of the golf ball where none of the paths intersect a dimple is disclosed. The seven great circular paths are obtained by laying out a cuboctahedron on the surface of the golf ball, dividing each of the six square faces of the cuboctahedron into four isosceles triangles by bisecting each square twice. The dimples are arranged by filling each triangle with dimples. A cuboctahedron is a fourteen-sided figure with eight triangular faces and six square faces. Bisecting the square faces twice provides a total of 32 triangles per cuboctahedron. Golf balls having seven great circular paths and 360, 384 and 408 dimples are disclosed.

15 Claims, 7 Drawing Sheets

GOLF BALL

The present invention relates to golf balls and, more particularly, to golf balls having seven parting lines and dimples evenly and uniformly distributed over the surface of the ball such that the dimple pattern, on one side of at least three parting lines immediately adjacent to the parting line, is a mirror image of the dimple pattern immediately adjacent to the other side of the parting line.

Typically, golf balls are made in a molding process that imparts a single mold parting line on the ball. Attempts have been made to increase the number of parting lines on a golf ball by adding so-called false parting lines. However, such attempts have produced large, bald spots or parting lines that intersect dimples. Both of these outcomes are undesirable. A recent attempt, U.S. Pat. No. 4,560,168, describes a golf ball with six parting lines and dimple patterns which do not form mirror images along the parting lines. In the '168 patent, the dimples are arranged on the surface of a golf ball by first dividing the spherical surface of the golf ball into twenty triangles corresponding to a regular icosahedron, and then subdividing each triangle so formed into four smaller triangles. Those smaller triangles are formed by joining the midpoints of each of the icosahedron triangles. The parting lines are coextensive with the lines that join the midpoints. Such a pattern produces an uneven or non-mirror image dimple pattern along any given parting line as is clearly evident from the description and drawings of the '168 patent.

Generally, golfers prefer a mirror image dimple pattern along the parting line because they often use the parting line to align their shots, and a mirror image dimple pattern along the parting line provides a visual balance. A non-mirror image dimple pattern along the parting line provides a visual unevenness and can ruin the golfer's shot. The present invention overcomes these disadvantages as well as others.

The present invention provides a golf ball with seven parting lines which correspond to seven great circular paths that encircle the golf ball, where none of the parting lines intersect any of the dimples and where the dimple pattern, immediately adjacent to one side of the parting line of at least three parting lines, is a substantial mirror image of the dimple pattern immediately adjacent to the other side of the parting line.

The dimple pattern of the present invention is obtained by dividing the surface of the golf ball into twenty-four isosceles triangles and eight equilateral triangles. These triangles are located by inscribing a cuboctahedron inside the spherical surface of a golf ball and then quartering the six square faces of the cuboctahedron into isosceles triangles. The square faces are quartered by connecting opposite corners of the squares. The quartering of the six square faces of the cuboctahedron forms twenty-four isosceles triangles. Four of the great circular paths follow the edges of the cuboctahedron itself, while the remaining three correspond to the lines that quartered the square faces of the cuboctahedron by connecting the opposite corners of each of the six squares. The seven great circular paths correspond to the position of the parting lines on the surface of the golf ball. The parting lines are coextensive with the seven great circular paths. Preferably, the mold parting line correspondes to one of the parting lines of the present invention, while the other six parting lines are false parting lines.

Dimples are evenly and uniformly distributed over the surface of the golf ball by arranging dimples inside each of the twenty-four isosceles triangles and in each of the eight equilateral triangles, making sure that none of the dimples intersect any of the common edges between the triangles. The dimples may be of any size, shape and number to include patterns with multiple sized dimples. Preferably, at least about 50% of the surface of the golf ball is covered with dimples.

The preferred dimple patterns have 360, 384 or 408 dimples. Some manufacturers remove a small number of dimples, typically eight, four at each pole, so that a trademark and identification number can be affixed to the ball. However, modern stamping methods allow for affixing trademarks and identification numbers without the removal of dimples.

A cuboctahedron is a fourteen-sided figure with eight sides being equilateral triangles and six being squares.

In order to obtain a substantial mirror image dimple pattern with respect to the dimples that are immediately adjacent to the parting lines which are along at least three of the parting lines, the dimple patterns in each of the twenty-four isosceles triangles are substantially identical.

These and other aspects of the present invention may be more fully described with reference to the accompanying drawings wherein.

Figure 1:
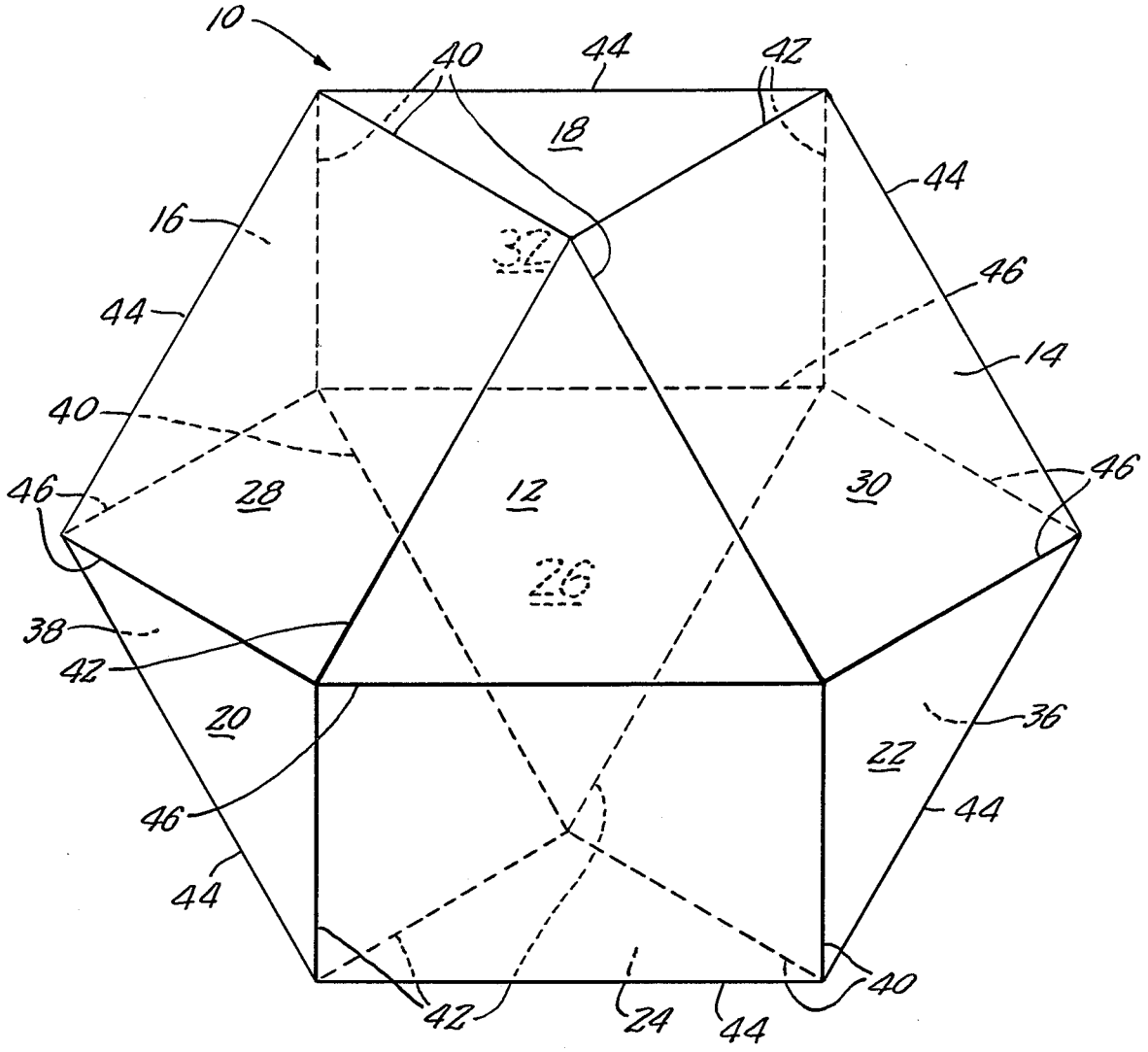
FIG. 1 illustrates a cuboctahedron.

FIG. 1 illustrates cuboctahedron 10 having equilateral triangle faces 12, 14, 16, 18, 20, 22, 24, 26 and square faces 28, 30, 32, 34, 36 and 38.

Four of the seven great circular paths correspond to the edges of the cuboctahedron and are labeled 40, 42, 44 and 46.

Figure 2:
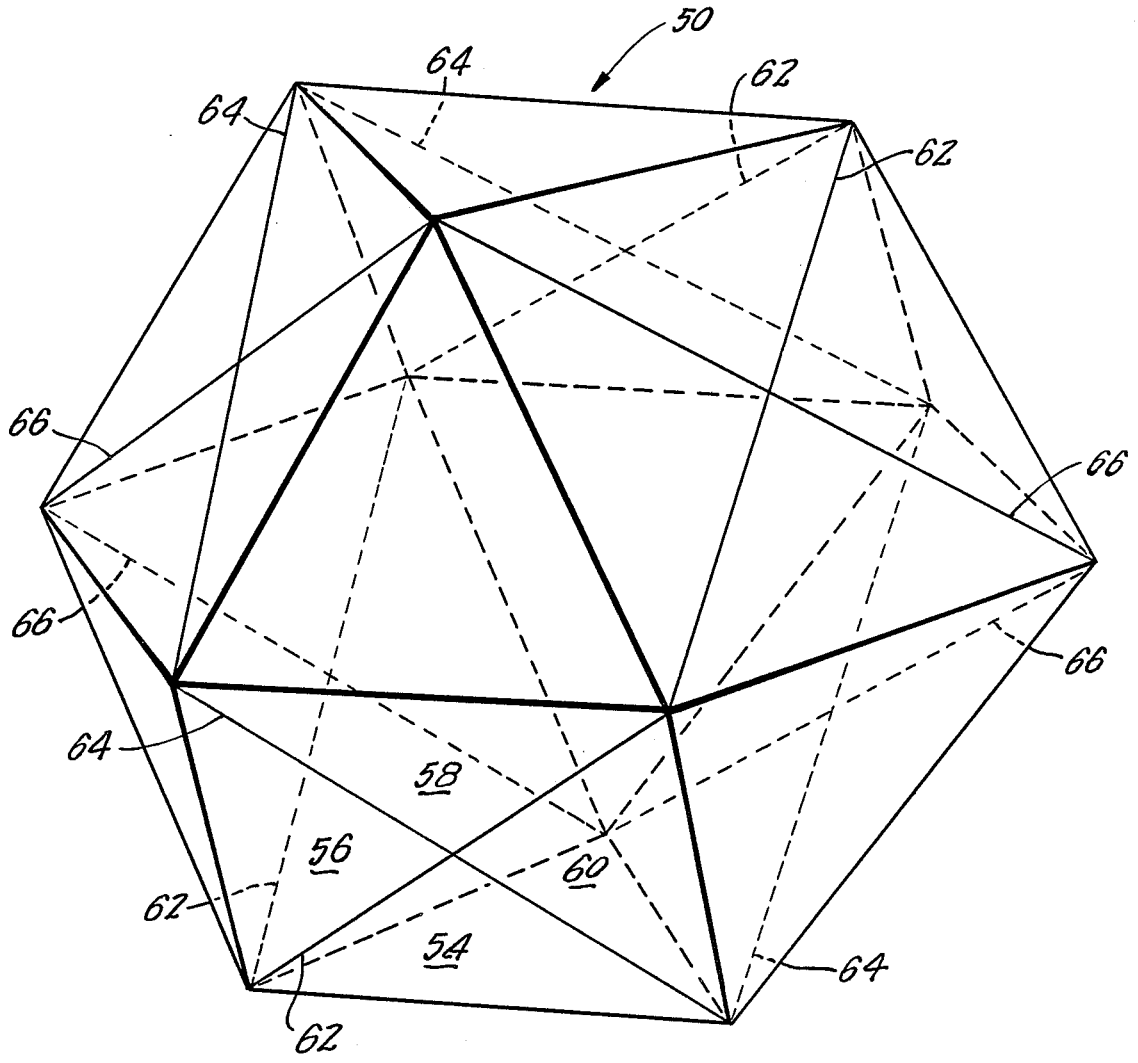
FIG. 2 illustrates a cuboctahedron which has had each square face quartered in accordance with the present invention.

FIG. 2 illustrates cuboctahedron 50 having each square face quartered by connecting opposite corners on each square face, thereby, bisecting each square face twice. For the purpose of illustration, the 4 isosceles triangles of face 52 have been labeled 54, 56, 58 and 60 thereon. The remaining 3 great circular paths correspond to the square face's bisecting lines and are labeled 62, 64 and 66.

Figure 3:
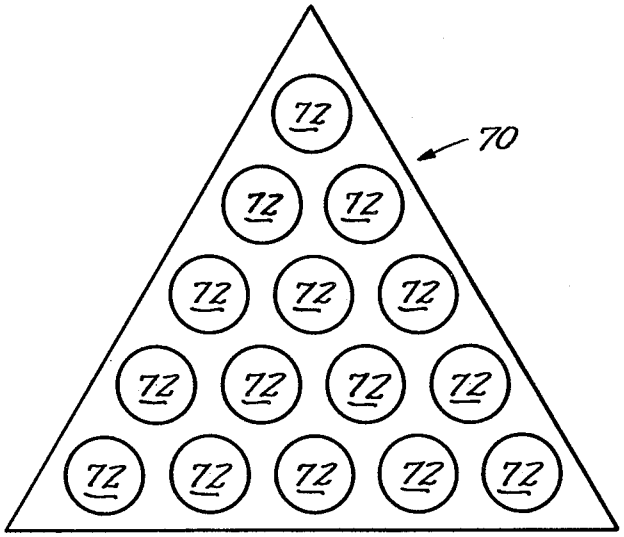
FIG. 3 illustrates a preferred equilateral triangle of a cuboctahedron having a dimple pattern for a golf ball with 360 dimples made in accordance with the present invention.
Figure 4:
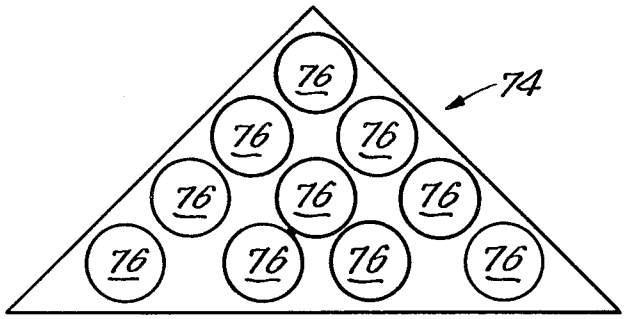
FIG. 4 illustrates a preferred isosceles triangle of a cuboctahedron having a dimple pattern for a golf ball with 360 dimples made in accordance with the present invention.

FIGS. 3 and 4 illustrate a preferred dimple pattern of an equilateral triangle and an isosceles triangle used for making a golf ball in accordance with the present invention having 360 dimples thereon. FIG. 3 illustrates a preferred equilateral triangle 70 of a cuboctahedron having a dimple pattern in accordance with the present invention for making a golf ball with 360 dimples. Dimples 72 have a maximum dimple diameter of about 0.150 inches. FIG. 4 illustrates a preferred isosceles triangle 74 of a cuboctahedron having a dimple pattern for a golf ball made in accordance with the present invention. Such a pattern produces a preferred 360 dimples. Dimples 76 have a maximum dimple diameter of about 0.140 inches.

Figure 5:
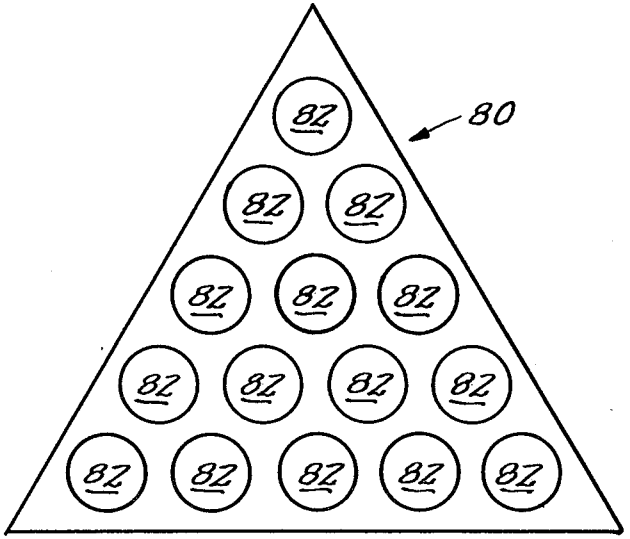
FIG. 5 illustrates a preferred equilateral triangle of a cuboctahedron having a dimple pattern for a golf ball with 384 dimples made in accordance with the present invention.
Figure 6:
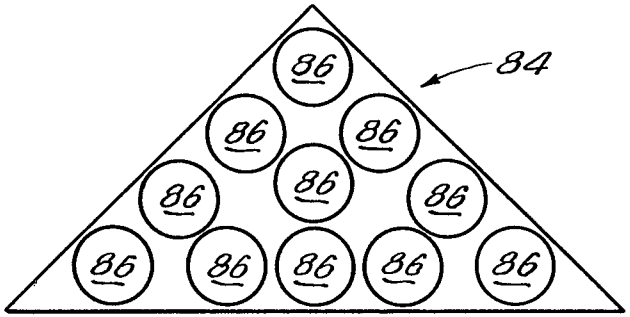
FIG. 6 illustrates a preferred isosceles triangle of a cuboctahedron having a dimple pattern for a golf ball with 384 dimples made in accordance with the present invention.

FIGS. 5 and 6 illustrate a preferred dimple pattern of an equilateral triangle and an isosceles triangle used to make a golf ball in accordance with the present invention having 384 dimples. FIG. 5 illustrates a preferred equilateral triangle 80 of a cuboctahedron having a dimple pattern for a golf ball made in accordance with the present invention such that a golf ball with a preferred 384 dimples is produced. Dimples 82 have a maximum dimple diameter of about 0.150 inches. FIG. 6 illustrates a preferred isosceles triangle 84 of a cuboctahedron having a dimple pattern for a golf ball made in accordance with the present invention such that a golf ball with a preferred 384 dimples is produced. Dimples 86 have a maximum dimple diameter of about 0.140 inches.

Figure 7:
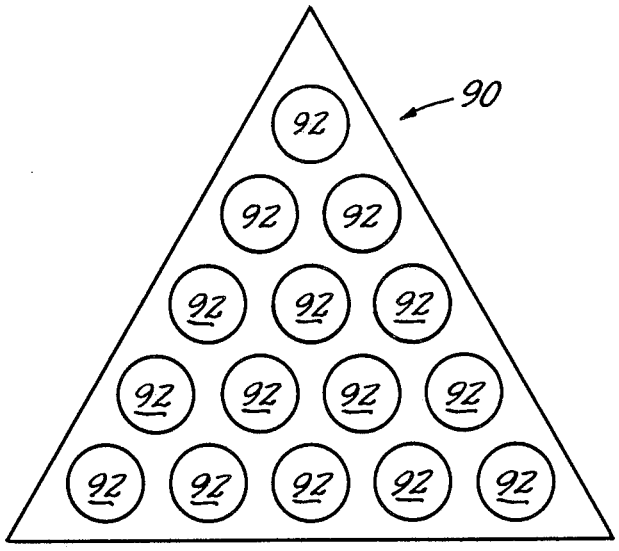
FIG. 7 illustrates a preferred equilateral triangle of a dimple pattern for a golf ball with 408 dimples made in accordance with the present invention.
Figure 8:
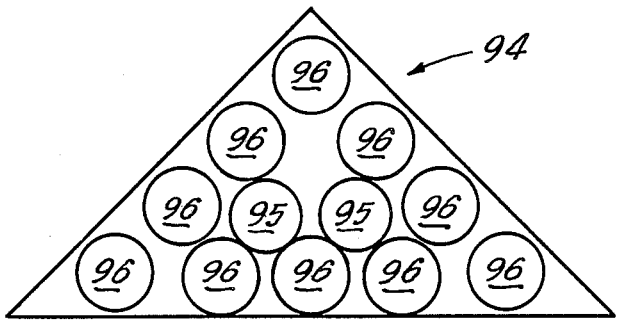
FIG. 8 illustrates a preferred isosceles triangle of a cuboctahedron having a dimple pattern for a golf ball with 408 dimples made in accordance with the present invention.

FIGS. 7 and 8 illustrate a preferred dimple pattern for a equilateral triangle and an isosceles triangle used to make a golf ball in accordance with the present invention and having 408 dimples thereon. FIG. 7 illustrates a preferred equilateral triangle 90 of a cuboctahedron having a dimple pattern for a golf ball made in accordance with the present invention such that a golf ball with a preferred 408 dimples is produced. Dimples 92 have a maximum dimple diameter of about 0.150 inches. FIG. 8 illustrates a preferred isosceles triangle 94 of a cuboctahedron having a dimple pattern for a golf ball made in accordance with the present invention such that a golf ball with a preferred 408 dimples is produced. Dimples 95 have a maximum diameter of about 0.125 inches, while dimples 96 have a maximum diameter of about 0.140 inches.

Figure 9:
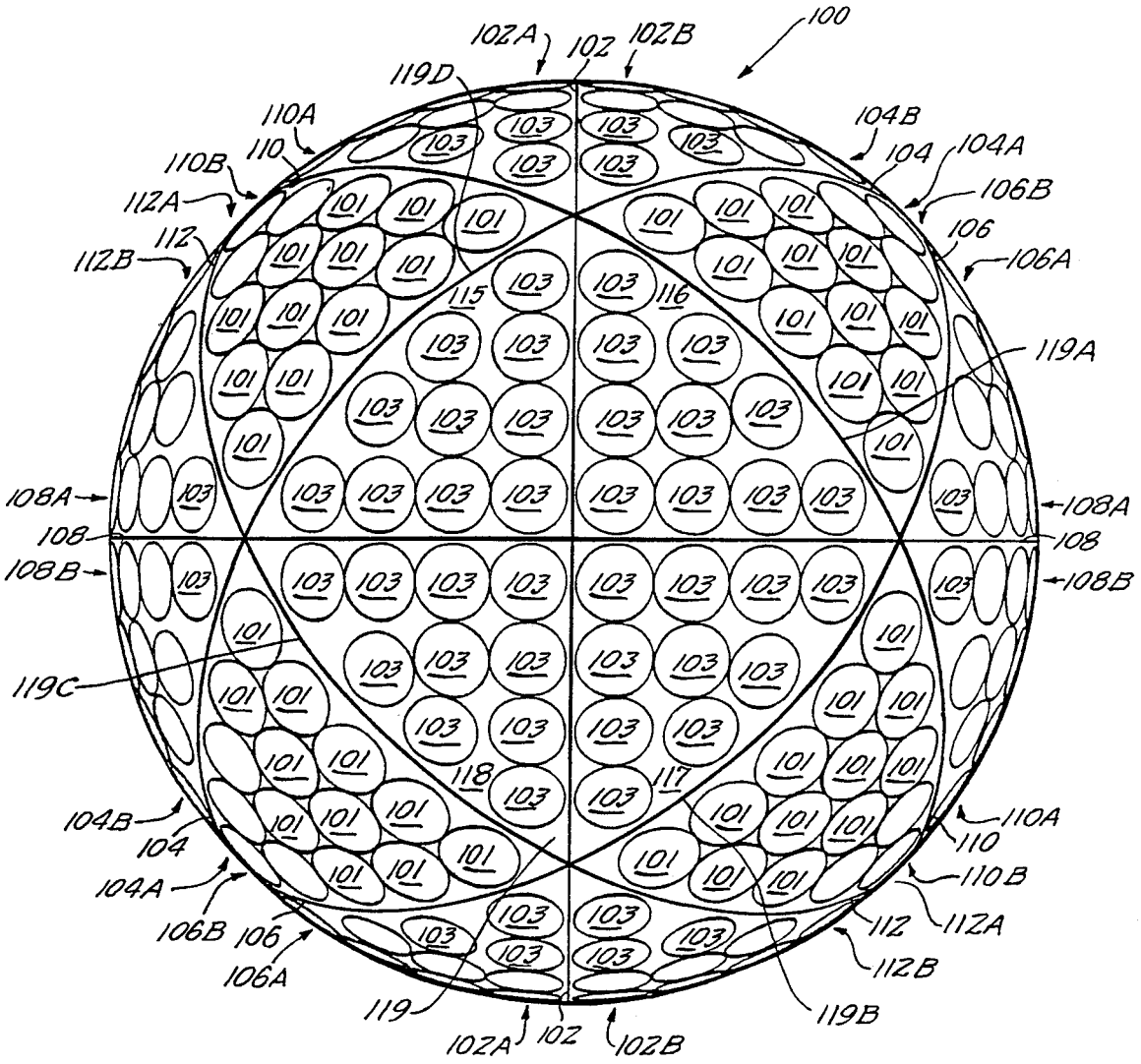
FIG. 9 illustrates a projected golf ball having 360 dimples made in accordance with the present invention.

FIG. 9 is a projected view of a preferred golf ball made in accordance with the present invention, having 360 dimples thereon. On golf ball 100, dimples 101 and 103 are arranged using the pattern of FIGS. 3 and 4, respectively. Great circular paths 102, 104, 106, 108, 110 and 112 are labeled. Dimples 101 and 103 on golf ball 100 have a diameter of about 0.150 and about 0.140 inches, respectively. Four isosceles triangles have been labeled 115, 116, 117 and 118. These four isosceles triangles, 115, 116, 117 and 118, make up cuboctahedron square face 119. For the purpose of identification, the four sides of square 119 have been labeled 119A, 119B, 119C and 119D. The mirror image dimple pattern of the present invention is illustrated along great circular paths 102 and 108. The dimples in column 102A substantially mirror the dimples in column 102B. Likewise, the dimples in row 108A substantially mirror the dimples in row 108B. Great circular paths 102 and 108 are coextensive with the bisecting lines of square face 119.

It is also readily apparent that the dimple pattern in triangle 116 is a substantial mirror image of the dimple pattern in triangle 117, and the dimple pattern in triangle 15 is a substantial mirror image of the dimple pattern in triangle 116. Such a mirror image exists along three of the great circular paths of the golf ball in FIG. 9.

Figure 10:
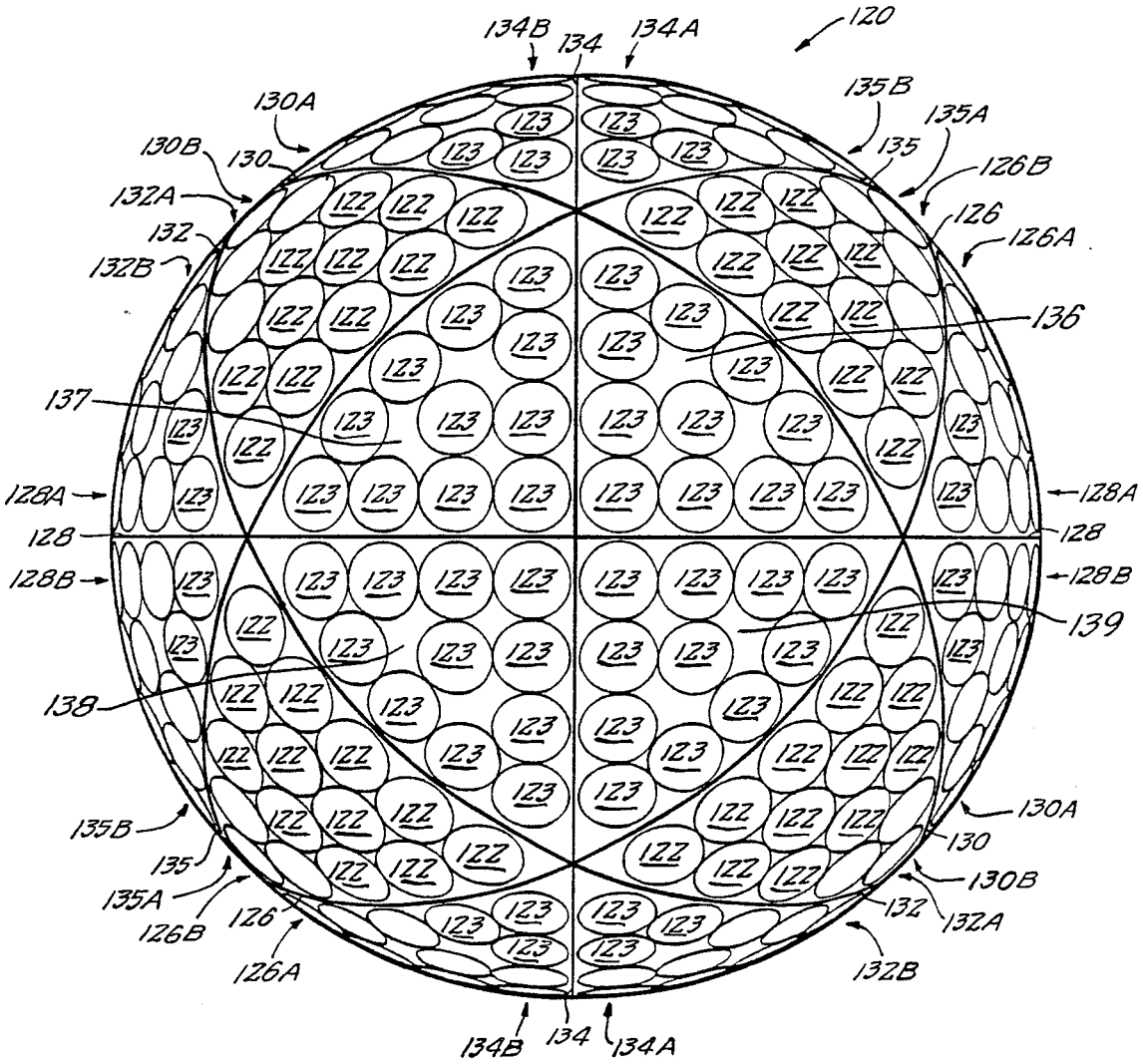
FIG. 10 illustrates a projected golf ball having 384 dimples made in accordance with the present invention; and, FIG. 11 illustrates a projected golf ball having 408 dimples made in accordance with the present invention.

FIG. 10 is a projected view of a preferred golf ball made in accordance with the present invention and having 384 dimples thereon. On golf ball 120, dimples 122, and 123 are arranged using the patterns of FIGS. 5 and 6, respectively. Dimples 122 and 123 have a diameter of about 0.150 and about 0.140 inches, respectively. Great circular paths 126, 128, 130, 132, 134 and 135 are labeled. Four isosceles triangles are labeled 136, 137, 138 and 139. These four isosceles triangles, 136, 137, 138 and 139, make up a square face of a cuboctahedron in the same manner as disclosed with respect to FIG. 9. The mirror image dimple pattern of the present invention is illustrated along great circular paths 128 and 134. The dimple row 128A is substantially mirrored in row 128B, and column 134A is substantially mirrored in column 134B. Great circular paths 128 and 134 are coextensive with the bisecting line of the square made up of the four isosceles triangles 136, 137, 138 and 139. In this embodiment of the present invention, the substantial mirror image dimple patterns also exists along each of the great circular paths 126, 130, 132 and 135 when dimples 122 and 123 are substantially similar in diameter. Compare the dimple patterns in rows 126A, 130A, 132A and 135A with the respective dimple patterns in rows 126B, 130B, 132B and 135B. It can be seen that the mirror image dimple pattern of the present invention exists along more than three parting lines in this embodiment of the present invention. More specifically, the mirror image dimple pattern in the embodiment of the 384 dimpled ball exists along each of the seven great circular paths. This is made possible by the fact that each of the dimples on golf ball 120 is substantially identical in diameter.

It is also readily apparent that the dimple pattern in triangle 136 is a substantial mirror image of the dimple pattern in triangle 139, and that the dimple pattern in triangle 137 is a substantial mirror image of the dimple pattern in triangle 136. Such a mirror image exists along each of the great circular paths of the golf ball in FIG. 10.

Figure 11:
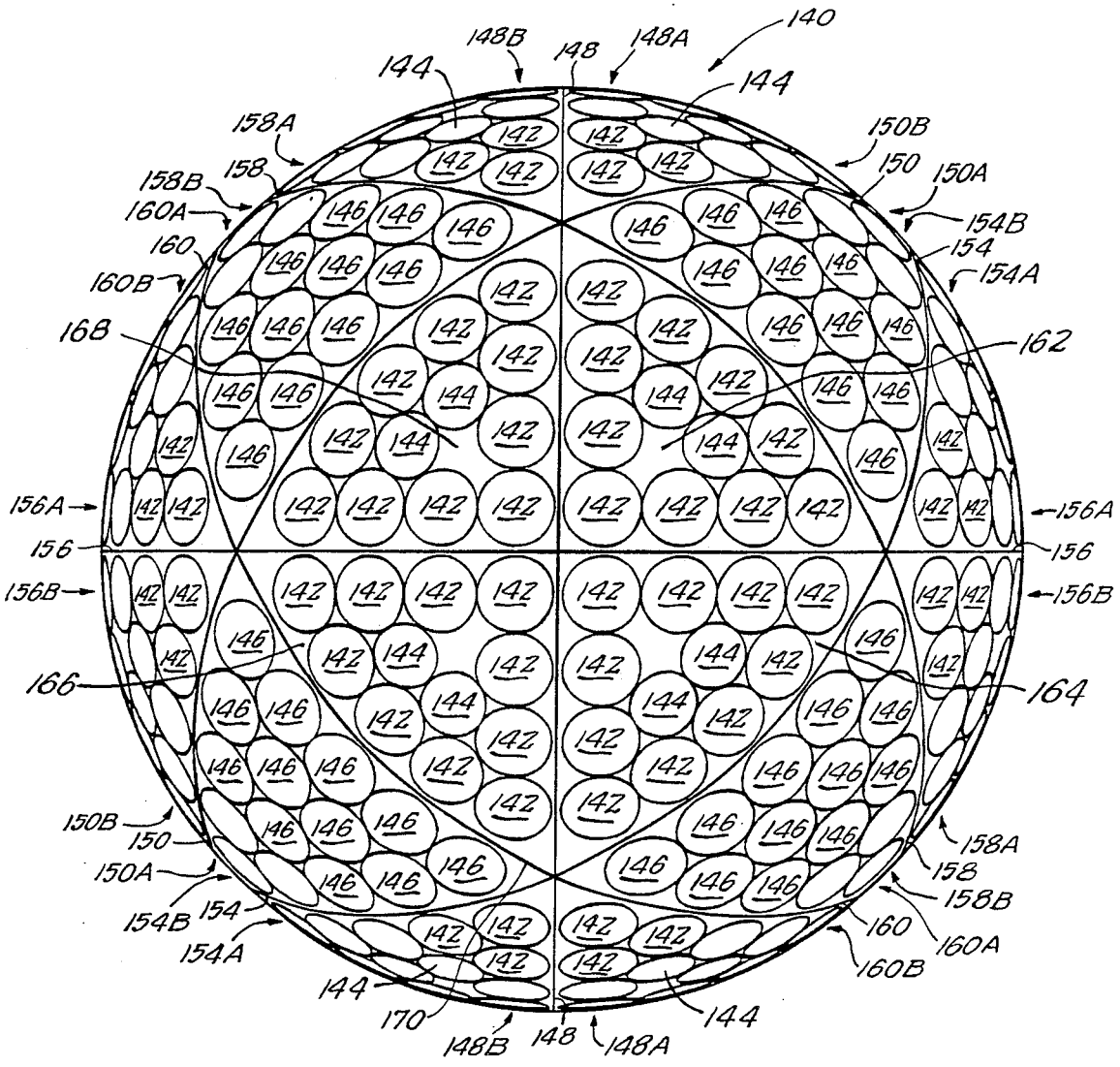

FIG. 11 is a projected view of a preferred golf ball made in accordance with the present invention, having 408 dimples thereon. On golf ball 140, dimples 142 and 144 are arranged thereon using the pattern of FIG. 7, while dimples 146 are arranged thereon using the pattern of FIG. 8. Dimples 142 have a diameter of about 0.140 inches, dimples 144 have a diameter of about 0.125 inches and dimples 146 have a diameter of about 0.150 inches. Great circular paths 148, 150, 152, 154, 158 and 160 are labeled. Four isosceles triangles are labeled 162, 164, 166 and 168. The four isosceles triangles, 162, 164, 166 and 168, make up the square 170 of the cuboctahedron used to make golf ball 140. Great circular paths 148 and 156 are coextensive with the two bisecting lines of square 170.

The mirror image dimple pattern of the present invention is illustrated along great circular paths 148, 150, 152, 154, 158 and 160. The rows of dimples marked 148A, 150A, 152A, 154A, 158A and 160A are mirrored by their respective rows of dimples marked 148B, 150B, 152B, 154B, 158B and 160B. It is clear that the mirror image dimple pattern of the present invention exists along all seven great circular paths. As with FIG. 10, this is made possible when the dimple diameter of dimples 142 and 146 are substantially identical.

It is also readily apparent that the dimple pattern in triangle 162 is a substantial mirror image of the dimple pattern in triangle 164, and that the dimple pattern in triangle 168 is a substantial mirror image of the dimple pattern in triangle 162. Such a mirror image exists along each of the great circular paths of the golf ball in FIG. 11.

For any number appearing in the claims which is not modified by the term "about", it will be understood that the term "about" modifies such number. A dimple, as used in the specification and claims and as used in the golf industry, is a standard term well known to those of skill in the art.

When referring to a dimple diameter, the term "diameter", as used herein, means the diameter of a circle defined by the edges of the dimple. When the edges of a dimple are non-circular, the diameter means the diameter of a circle which has the same area as the area defined by the edges of the dimples. When the term "depth" is used herein, it is defined as the distance from the continuation of the periphery line of the surface of the golf ball to the deepest part of a dimple which is a section of a sphere. When the dimple is not a section of a sphere, the depth, in accordance with the present invention, is computed by taking a cross section of the dimple at its widest point. The area of the cross section is computed and then a section of a circle of equal area is substituted for the cross section. The depth is the distance from the continuation of the periphery line to the deepest part of the section of the circle.

It will be understood that the claims are intended to cover all changes and modifications of the preferred embodiment of the invention herein chosen for the purpose of illustration, which do not constitute a departure from the spirit and scope of the invention.

What is claimed is:

1. A golf ball having a spherical surface with a plurality of dimples formed thereon, and seven parting lines which do not intersect any dimple, the dimples being arranged by dividing the spherical surface into twenty-four isosceles triangles and eight equilateral triangles, said twenty-four isosceles triangles and eight equilateral triangles being formed by inscribing a cuboctahedron in said spherical surface and bisecting each square face on said cuboctahedron into four isosceles triangles, four of said seven parting lines corresponding to the edges of said cuboctahedron and the remaining three of said seven parting lines corresponding to the square faces' bisecting lines, said dimples being arranged in said twenty four isosceles triangles and said eight equilateral triangles such that the dimples do not intersect the seven parting lines.

2. The golf ball of claim 1 wherein each isosceles triangle has substantially similar dimple patterns.

3. The golf ball of claim 1 wherein each isosceles triangle has substantially similar dimple patterns and each equilateral triangle has substantially similar dimple patterns.

4. The golf ball of claim 1 wherein the total number of dimples is 360.

5. The golf ball of claim 1 wherein the total number of dimples is 384.

6. The golf ball of claim 1 wherein the total number of dimples is 408.

7. The golf ball of claim 1 wherein the dimples have at least two different diameters.

8. A golf ball having a spherical surface with a plurality of dimples thereon and seven great circular paths which do not intersect any dimples, the circular paths being arranged on the spherical surface by inscribing a cuboctahedron in the spherical surface and bisecting each square face of said cuboctahedron twice to form four isosceles triangles, said seven great circular paths corresponding to the bisecting lines of said square faces, which define three great circular paths, the remaining four great circular paths corresponding to the edges of the cuboctahedron.

9. The golf ball of claim 8 wherein each isosceles triangle has substantially similar dimple patterns.

10. The golf ball of claim 8 wherein each isosceles triangle has substantially similar dimple patterns and each equilateral triangle has substantially similar dimple patterns.

11. The golf ball of claim 8 wherein the total number of dimples is 360.

12. The golf ball of claim 8 wherein the total number of dimples is 384.

13. The golf ball of claim 8 wherein the total number of dimples is 408.

14. The golf ball of claim 8 wherein the dimples have at least two different diameters.

15. A golf ball having a spherical surface with a plurality of dimples thereon and seven parting lines which do not intersect any dimples, four of said seven parting lines corresponding to circular paths which coextend with edges of a cuboctahedron inscribed in said spherical surface, and the remaining three parting lines of said seven parting lines coextend with twelve bisecting lines, said twelve bisecting lines corresponding to lines that bisect square faces of said cuboctahedron to form four isosceles triangles, said dimples being arranged in said isosceles triangles and in equilateral triangles of said cuboctahedron.

* * * * *

UNITED STATES PATENT AND TRADEMARK OFFICE

CERTIFICATE OF CORRECTION

PATENT NO. : 4,762,326

DATED : August 9, 1988

INVENTOR(S) : William Gobush

It is certified that error appears in the above-identified patent and that said Letters Patent are hereby corrected as shown below:

Column 4, line 11, change "15" to --115--.

Column 6, line 19, change "diameters" to --sizes--.

Column 6, line 44, change "diameters" to --sizes--.

Signed and Sealed this

Fourteenth Day of March, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,762,326

DATED : August 9, 1988

INVENTOR(S) : William Gobush

It is certified that error appears in the above-identified patent and that said Letters Patent is hereby corrected as shown below: In the Drawings:

Amend Fig. 1 by adding reference numeral "34" as shown below:

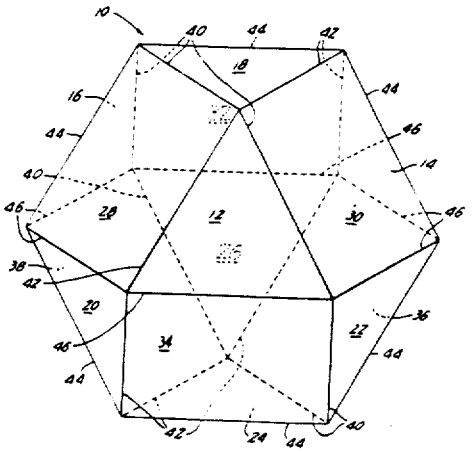

Amend Fig. 2 by adding reference numeral "34" as shown below:

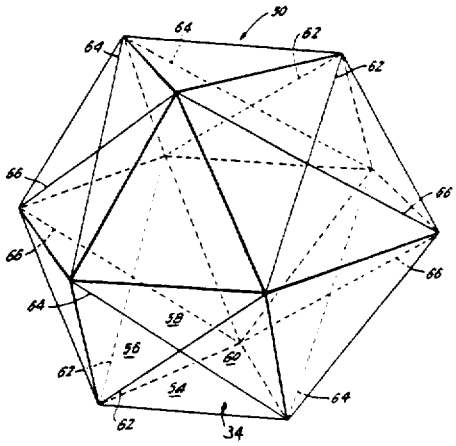

UNITED STATES PATENT AND TRADEMARK OFFICE

CERTIFICATE OF CORRECTION

PATENT NO. : 4,762,326

DATED : August 9, 1988

INVENTOR(S) : William Gobush

It is certified that error appears in the above-identified patent and that said Letters Patent is hereby corrected as shown below:

Column 3, line 8, change "52" to --34--.

Signed and Sealed this

Ninth Day of November, 1993

Bruce Lehman

*Attest:*

BRUCE LEHMAN

*Attesting Officer*

*Commissioner of Patents and Trademarks*